United States Patent [19]

Yamada

[11] Patent Number: 4,535,990

[45] Date of Patent: Aug. 20, 1985

[54] GOLF CLUB HEAD

[75] Inventor: Magoichi Yamada, Tokyo, Japan

[73] Assignee: Daiwa Golf Co., Ltd., Kurume, Japan

[21] Appl. No.: 552,757

[22] Filed: Nov. 17, 1983

[30] Foreign Application Priority Data

Nov. 24, 1982 [JP] Japan ..... 57-177367[U]
Feb. 26, 1983 [JP] Japan ..... 58-27875[U]

[51] Int. Cl.[3] ..... A63B 53/04
[52] U.S. Cl. ..... 273/173; 273/167 H
[58] Field of Search ..... 273/167 R, 167 A, 167 F, 273/167 H, 169, 171, 174, 68, DIG. 7, 173

[56] References Cited

U.S. PATENT DOCUMENTS 3,547,445 12/1970 Hardesty ..... 273/173
3,567,228 3/1971 Lynn ..... 273/169
4,313,607 2/1982 Thompson ..... 273/167 H

FOREIGN PATENT DOCUMENTS 2060411 5/1981 United Kingdom ..... 273/68

*Primary Examiner*—Richard C. Pinkham
*Assistant Examiner*—Vincent A. Mosconi
*Attorney, Agent, or Firm*—Fred Flam

[57] ABSTRACT

A golf club head is hollowed out to provide desired light weight characteristics. A tubular reinforcement material formed of plastic including reinforcement fibers, separate from the club head itself, is inserted into the cavity attached at the inner walls of the face and back, so as to span between them to prevent deformation of the head face and to hold the stiffness and mechanical strength required at its impact face.

1 Claim, 9 Drawing Figures

GOLF CLUB HEAD

FIELD OF THE INVENTION

This invention relates to a golf club head and, more specifically, to the so-called "wood" or "driver" type, and this invention especially relates to improvement of the gold club head with a cavity inside.

BACKGROUND OF THE INVENTION

Recently, plastic materials such as NYLON 66 or ABS plastic resin reinforced by carbon or glass fiber have superseded natural woods such as persimmon and cherry tree for so-called "wood" or "driver" type golf club heads. A customary way is to form a cavity in the club head by hollowing out the inside of the club head from its sole plate fixing side and making a light-weight club head by enlarging its cavity.

However, there have been problems in that enlargement of the cavity which causes the thinness of the head face where ball impacts take place, gives undesirable effect on the flying distance of the ball at the time of impact for a deformation of the face plate and reduces the mechanical strength of its face plate.

Although the disclosure of Japanese Utility Model Application No. 52-27370 provides a number of horizontal grooves on the club head from its face side to its back side, this type of gold club head could not reduce so much weight of the club head as expected and the production requires very high workmanship for its complicated form. Also, the disclosure of Japanese Utility Model Application No. 52-11460 provides impact core uniform from its face side to back side on the club head, but this type of club head did not meet the reduction of its weight because it must make the head face rather thick for preventing its face side from deformation and, moreover, because of the unified formation, it had a shortcoming that could not especially reinforce the front impact core.

SUMMARY OF THE INVENTION

The present invention resolves the previous problems above-described and its objective is, by providing a reinforcement material which prevents a deformation of the head face separate from the club head itself in a cavity formed in the head, to provide a golf club head which can hold the stiffness and the mechanical strength required at its impact face and adjust or reduce its weight even if its head face becomes thin due to an enlargement of the cavity in the club head.

Another objective of this invention is to provide the golf club head with sufficient mechanical strength and modulus of elasticity at the plate avoiding that the arrangement of the reinforcement material on the head face will give undesirable effects on reducing and balancing of weight of the club head itself.

BRIEF DESCRIPTION OF THE DRAWINGS

A detailed description of the invention will be made with reference to the accompanying drawings wherein like numerals designate corresponding parts in the several figures. These drawings are to scale.

DETAILED DESCRIPTION OF PREFERRED EMBODIMENT

Figure 1:
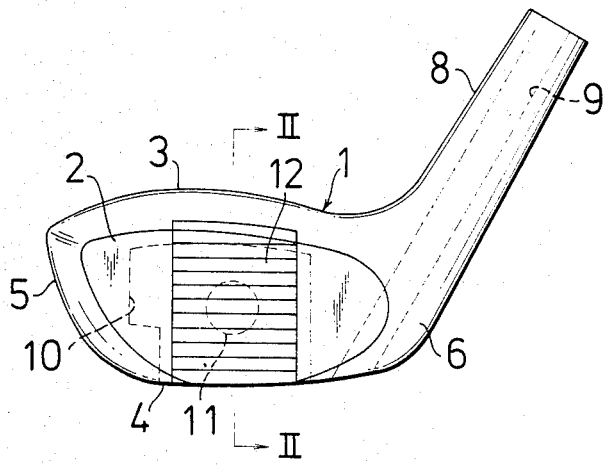
FIG. 1 is a front view of the golf club head for the first practical example of the present invention.
Figure 2:
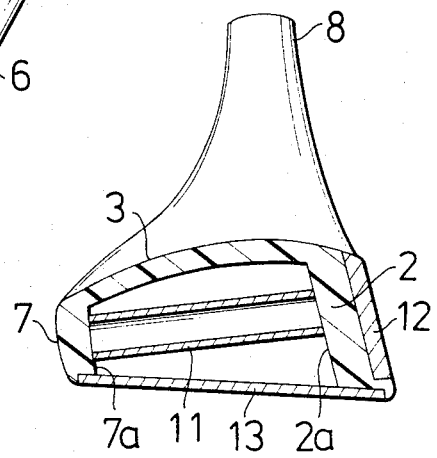
FIG. 2 is a section along lines II—II of FIG. 1.
Figure 3:
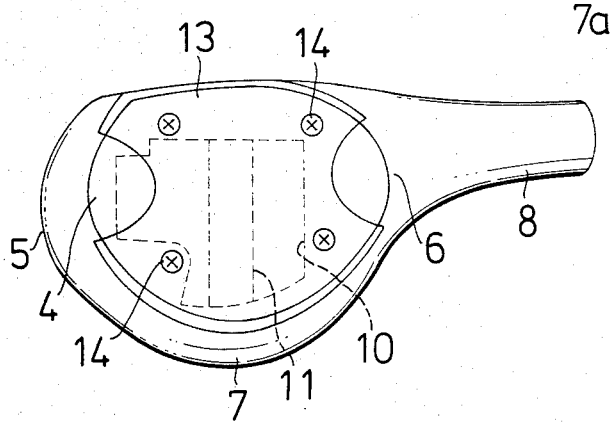
FIG. 3 is a bottom view of the golf club head for the first practical sample.

The following detailed description is made of the best presently contemplated modes of carrying out the invention. This description is not to be taken in a limiting sense, but is made merely for purposes of illustrating the general principles of the invention since the scope of the invention is best defined by the appended claims. Structural and operational characteristics attributed to forms of the invention first described shall also be attributed to forms later described, unless such characteristics are obviously inapplicable or unless specific exception is made.

FIGS. 1–4 show the first practical examples of the golf club head relating to this invention or "wood head". The club head 1 formed of plastics has the face 2, the top 3, the sole 4, the toe 5, the heel 6 and the back 7; the neck 8 that projects inclined upward from the heel 6; and the hosel 9 for connection to a golf club shaft made of metal (not illustrated in the figure) is formed concentrically in the neck 8. Plastics such as polycarbonate, ABS plastic resin or NYLON 66, or those with 20–60 weight percent addition of reinforcement fibers such as carbon fiber or glass fiber 7–8 micron in diameter at a length of 0.1–1 mm, are the material for use on the shaped head 1. Such plastics are commercially available from Mitsubishi Rayon Co., Ltd. The head 1 is formed as such by heating, melting and molding the above materials by injection device, to be solidified.

The cavity 10 is formed, in the above described head 1 which is made of plastic materials, by hollowing out from the side of the sole 4 at desired surface area and depth, by which the weight of the head 1 can be reduced and adjusted as desired and the weight distribution among toe, heel and back are made suitable to the wood head. In the cavity 10 the pipe-shaped reinforcement material 11 is arranged in diameter between *2a*, the inside to the center part of the face 2, and *7a*, the inside of the back 7; and both ends of the reinforcement material 11 are fixed on the inside *2a* and *7a*, respectively. In such way, the reinforcement material 11 is able to give stiffness and strength required for the impact to the face 2 which lowered its mechanical strength because of the cavity inside the head 1 and is formed of carbon fiber or glass fiber piled at random and molded with plastics, or a pipe-shaped material molded with layers of carbon fiber sheets or glass fiber sheets. Also, the face plate 12 constructed of reinforcement fiber such as carbon or glass, and plastics such as polycarbonate, is embedded for use as necessary.

At the sole 4 of the above described plastic head 1 (FIG. 3) the sole plate 13 is embedded so as to close the cavity 10, i.e., it is fixed with tap screw 14 where plate surface corresponds to the sole outside surface. This will further facilitate the lightening of the head weight if the sole plate 13 is, say, made of reinforcement fiber sheet material such as carbon or glass, and plastic sheets such as polycarbonate, many of which are laminated and molded (reinforcement fiber sheet is 20–60 weight percent), or made of compressed and heated plastic materials and reinforcement short fiber of 20–60 weight percent. The lightening of the head is facilitated at the above constructed wood head and, at the same time, the light reinforcement material 11 fitted in the cavity 10 improves the mechanical strength and stiffness of the face part at the time of the enlargement of the cavity in the head so that no hollow of the face will occur.

Figure 4:
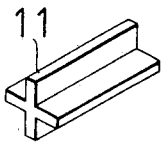
FIG. 4 is an oblique illustrating an example of the reinforcement material formation.
Figure 5:
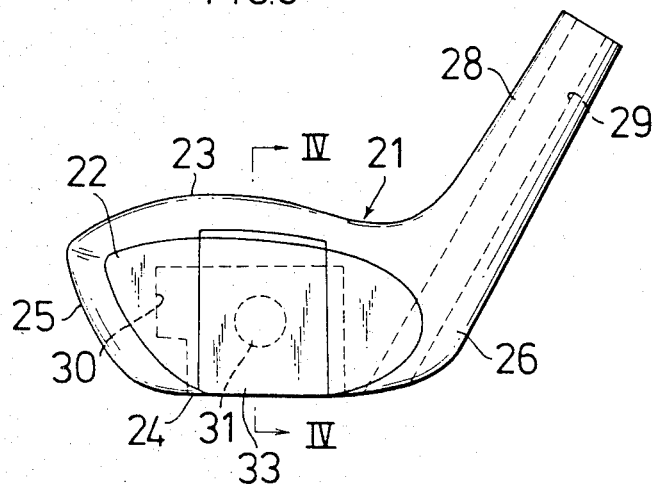
FIG. 5 is a front view of the golf club head for the second practical example of the present invention.

FIG. 4 shows an example of forming the reinforcement material for this present invention, i.e., the reinforcement material formed to be cross-shaped with carbon fiber and plastic.

It should be noted that a single reinforcement material 11 to be fixed in the cavity 10 of the head 1 is illustrated in the above practical example, but more than two of the same material may be fixed.

As mentioned above, for this invention a light reinforcement material is fixed in diameter between the face and its opposite side, namely, the back part in the cavity, for the lightening of the head so that the mechanical strength and stiffness required at the impact face can be fully obtained and the lightening of the head can be easily achieved even when the face itself is unable to get the required strength due to an enlargement of the face. Also, the reinforcement materials have sufficient functions as reinforcing constructions for the head without producing any effect on the lightening of the head, in that they are made of laminated and molded glass sheet or carbon sheet, or formed of carbon fiber or glass fiber molded with plastics.

DETAILED DESCRIPTION OF THE SECOND EMBODIMENT

FIGS. 5 to 8 illustrate the second practical examples of the present invention. A head 21 has a face 22, top 23, sole 24, toe 25, heel 26 and back 27; a neck 28 that projects inclined upward from the heel 26; and the hosel 29 for connection to a golf club shaft made of metal (not illustrated in the figure) is formed concentrically in the neck 28. The head 21 with this formation is made as described in the above practical example.

The cavity 30 is formed in the head 21 as in the above practical example, and a pipe-shaped material 31 is fixed in diameter between the center of inside 22*a* of the face 22 and the opposite side, namely, the inside 27*a* of the back 27 in the cavity 30.

The above described reinforcement material 31 consists of, for instance, pipe-shaped carbon fiber or glass fiber of 20–60 weight percent molded with the plastics such as polycarbonate, and sheet layer 32 of boron fiber or amorphous fiber whose structural direction is identical to the direction of the reinforcement material 31 and is fixed to the reinforcement material 31 at the full length and a voluntary width. A face plate 33 encloses the impact face of the face 22. A sole plate 34 closes the sole opening of the above described cavity 30.

For the wood head constructed as above described, the face 22 is supported from its inside by the reinforcement material 31 fixed in the cavity 30 so that a part of the impact force to the face 22 is received by the reinforcement 31 at the time of the ball impact and, for this reason, the mechanical strength of the face 22 is fully maintained even when the face 22 becomes thin due to the formation of the cavity 30. The formation of sheet layer 32 made of boron fiber or amorphous fiber to the outside surface of the reinforcement material 31 raises a coefficient of elasticity and stiffness of the reinforcement material 31, hollow stiffness of the face 22 and, accordingly, the force of elastic formation returns to its original state at the time the ball is in contact with the club head. Therefore, the impact energy for the ball to be rebounded from the impact face is increased.

Figure 6:
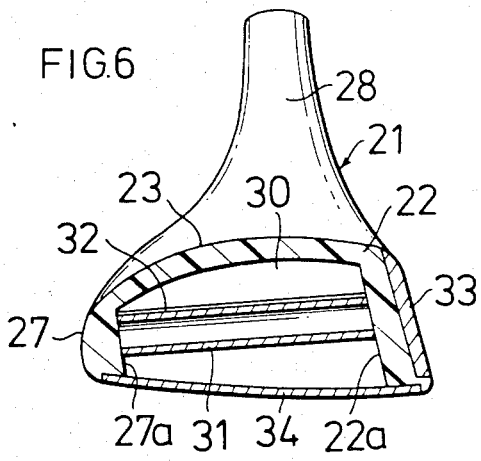
FIG. 6 is a section along lines VI—VI of FIG. 5.
Figure 7:
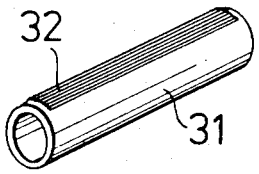
FIG. 7 is an exterior view illustrating an example of the reinforcement material of FIG. 5.
Figure 8:
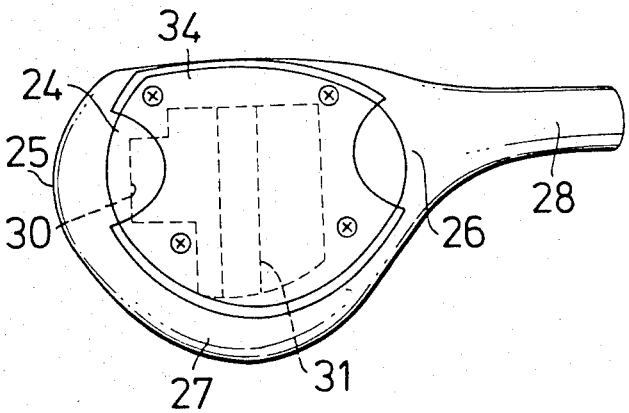
FIG. 8 is a bottom view of FIG. 5.

The specific gravity of boron fiber and amorphous fiber is more than twice as much as the one of carbon fiber (1.3) so that balancing of the head is available by the fitting of reinforcement material 31 of sheet layer 32 made of boron fiber and amorphous fiber. For instance, as illustrated in FIGS. 6 and 7, when the sheet layer 32 is positioned above the reinforcement material 31, the center of gravity of the head 21 can move upward and, if positioned the other way, the center moves downward.

Figure 9:
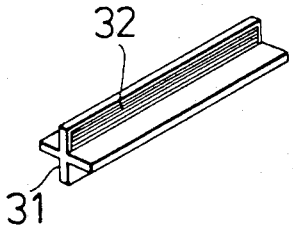
FIG. 9 is an exterior view illustrating an example of the reinforcement material formation.

FIG. 9 illustrates an example of reinforcement material 31 formation.

The same effect of the sheet layer 32 of boron fiber is available not only when fixed outside surface of the reinforcement material 31 as the practical example, but also, for instance, when added to the inside reinforcement material 31.

As mentioned above for the present invention, the provision of boron fiber and amorphous fiber layers to a part of the reinforcement material which supports the head face from inside the cavity, can achieve the mechanical strength and modulus of elasticity at a desired level without interfering with the lightening and balancing of weight and, moreover, the adjustment of the center of gravity at the head becomes practicable.

Intending to claim all novel, useful and unobvious features shown or described, I make the following claims:

1. A golf club head formed of fiber reinforced plastic in which there is a cavity surrounded with portal shaped walls formed by a face part, a top part and a back part of the head body and provided at the rear of the impact face, characterized by arranging a tubular reinforcement material formed of plastics including reinforcement fibers and disposed, abutting at its both ends on the inner walls of the face part and of the back part, so as to span between them; and a face plate made of fiber reinforced plastics and fixed at the front of the face part wall of the head body.

* * * * *